United States Patent [19]

Solow

[11] Patent Number: 4,761,720

[45] Date of Patent: Aug. 2, 1988

[54] ILLUMINATED TAPE

[75] Inventor: Joseph E. Solow, Plainview, N.Y.

[73] Assignee: Wolo Manufacturing Corporation, Deer Park, N.Y.

[21] Appl. No.: 50,283

[22] Filed: May 14, 1987

[51] Int. Cl.[4] ..... F21S 1/14; F21V 21/08

[52] U.S. Cl. ..... 362/252; 362/249; 362/800

[58] Field of Search ..... 362/249, 250, 800, 252

[56] References Cited

U.S. PATENT DOCUMENTS

| | | | |
|---|---|---|---|
| 3,037,137 | 5/1962 | Motson . | |
| 3,521,049 | 7/1970 | Young | 362/249 X |
| 3,714,414 | 1/1973 | Sternius | 362/249 |
| 3,737,647 | 6/1973 | Gomi . | |
| 3,755,663 | 8/1973 | George, Jr. . | |
| 3,894,225 | 7/1975 | Chao . | |
| 4,107,767 | 8/1978 | Anquetin . | |
| 4,173,035 | 8/1979 | Hoyt . | |
| 4,204,273 | 5/1980 | Goldberg | 362/249 X |
| 4,439,818 | 3/1984 | Scheib . | |

*Primary Examiner*—Tony M. Argenbright

*Attorney, Agent, or Firm*—Brumbaugh, Graves, Donohue & Raymond

[57] ABSTRACT

An illuminated tape includes an elongated, thin tape element composed of flexible, and at least partially translucent, plastic. A pair of longitudinally extending thin wires are embedded in the plastic, and a plurality of LED chips, also embedded in the plastic, are electrically connected in parallel between the wires. The electrical elements are therefore completely embedded in plastic producing a flexible illuminated tape which can operate off a low power source and which is waterproof and safe.

8 Claims, 1 Drawing Sheet

FIG. 1
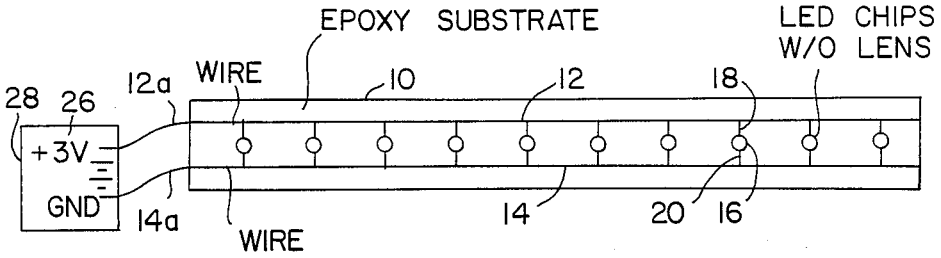
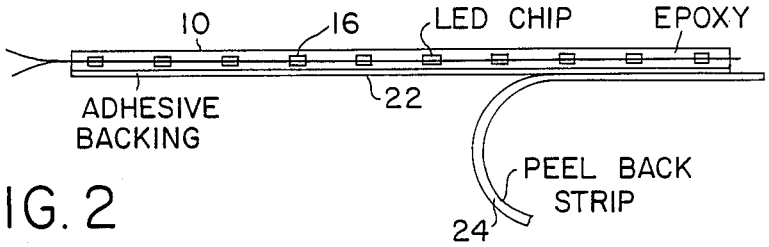
FIG. 2
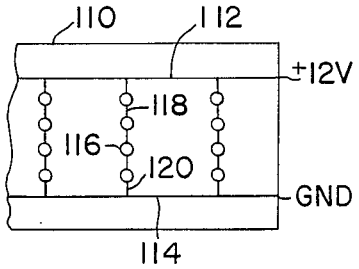
FIG. 3

ILLUMINATED TAPE

BACKGROUND OF THE INVENTION

The present invention is a weatherproof illuminated tape that may be used for decorative lighting or other purposes.

A common form of decorative lighting, often referred to as Christmas lights, employs a string of lights with individual bulbs or mini-lights mounted at spaced intervals in individual sockets.

The attraction of this type of lighting lies in the fact that it is flexible and can be mounted to surfaces of practically any shape, e.g. on Christmas trees or wreaths or around windows or doors. But, such lights, if not used carefully, are a known fire hazard in certain applications, e.g. use on indoor Christmas trees. Also, special measures must be taken if the lights are to be used out of doors, i.e. special outdoor lights (generally more expensive) which are water resistant must be used.

Chao U.S. Pat. No. 3,894,225 proposes sandwiching an elongated string of mini-lights between a pair of flexible transparent strips of plastic tape. The bulbs are connected in parallel between positive and negative thin wire leads that extend longitudinally along edges of the tape. The bulbs project outwardly through individual holes formed in the upper tape strip.

Scheib U.S. Pat. No. 4,439,818 proposes a similar structure, only using LED's instead of mini lamps. Positive and negative wires are laid out on adhesive tape and LED's, which are connected across the leads, project outwardly through holes formed in the tape.

The Chao and Scheib structures have inherent drawbacks. Fabrication of either product requires that the lamps or LED's be mounted on the carrier wires so that, when the electrical strip is joined to the upper tape strip, the lamps or LED's are in exact registry with the holes in the tape. Moreover, unless the holes are the exact size of the lamps, portions of the wires will be left exposed, which may produce a risk of shock. To solve the alignment problem, each of the bulbs or LED's could be positioned in the tape holes and individually wired in place. However, manufacture of the strip in such a manner would be labor intensive and therefore impractical for commercial purposes. Alternatively, the holes could be made larger to relieve the problems of alignment; but this will increase the problems associated with exposed wiring. Another problem is the fact that the bulbs or LED's project and are therefore exposed to damage. For such reasons, while Chao and Scheib propose the idea of a strip, neither appears to disclose a practical structure for doing so on a mass production basis.

SUMMARY OF THE INVENTION

The present invention is an illuminated tape comprising an elongated, thin tape element composed of flexible, and at least partially translucent plastic. A pair of longitudinally extending thin wires are embedded in the plastic and laterally spaced apart. A plurality of LED elements are also embedded in the plastic and longitudinally spaced along the tape element between the wires. A plurality of thin electrical connectors embedded in the plastic connect the LED's in parallel across the wires.

Preferably, the LED elements are LED chips (or "dice"), in which the normal lens element has been removed, and the tape element has a thickness slightly greater than the chip. If desired, an adhesive backing can be applied to one of the surfaces of the tape element, and preferably the plastic is transparent. If desired, for each parallel connection more than one LED chip may be connected in series across the lead wires.

In employing the present invention, the wires at one end of the tape are stripped and connected to a three-volt DC power source, e.g. contained in a battery pack. The tape can be cut off at any position along its length, and the LED's will be lit by the potential existing across the positive and negative leads.

In cases where it is desired to use a higher voltage, the embodiment of the invention employing more than one LED chip across the parallel network can be employed. The voltage drop produced thereby can be made to accommodate higher voltages. For example, with a 12 volt source, 4 LEDs connected in series between the wires will render a 12 volt source suitable for powering LEDs.

The tape strip decribed above is readily manufacturable. A pair of elongated thin wires are stretched in parallel, and the LED chips are connected between the wires, using connector wires, to form a ladder configuration. Thereafter, the wire network may be placed in a channel-shaped mold, and an epoxy poured into the mold to embed the wires and chips. The tape can be made in any length desirable and rolled up for storage.

In use, since the wires and chips are completely embedded in plastic, the unit is completely waterproof and safe. There is no danger of sparking or shorting as in known light strings. Also, because of the extremely low power requirements of the LED's, the device may be readily employed with a portable power source, such as standard dry batteries. The reduced voltage power source provides another element of safety.

For a better understanding of the invention, reference is made to the following detailed description of preferred embodiments, taken in conjunction with the drawings.

DESCRIPTION OF THE DRAWINGS

FIG. 1 is a top view of an illuminated tape in accordance with the invention;

FIG. 2 is a side view of the tape shown in FIG. 1; and

FIG. 3 is a top view of an alternative embodiment.

DETAILED DESCRIPTION OF PREFERRED EMBODIMENTS

An illuminated tape according to the invention includes an elongated, thin tape element 10 composed of a flexible, and at least partially translucent, and preferably transparent, plastic. A pair of longitudinally extending thin wires 12 and 14 are embedded in the plastic 10, and are laterally spaced apart. A plurality of LED chips 16, either of one selected color or a variety of different colors, are also embedded in the plastic at longitudinally spaced intervals along the tape element 10 between the wires 12, 14. Finally, a plurality of thin electrical connectors 18, 20 electrically connect the LEDs 16 in parallel across the wires 12, 14.

As noted above, the invention preferably makes use of LED chips. LED's, as commercially sold, normally include the LED element itself together with a lens. As used herein, the term "LED chip" refers to the LED element itself, with the lens removed. In this form, the LED chip is very small and therefore thin.

As can be seen in FIG. 2, the tape element 10 has a thickness which is only slightly greater than the LED chips 16. Using LED chips, the actual tape can be made quite thin and very flexible. As also shown in FIG. 2, an adhesive backing 22 is provided on the bottom of the tape element 10. Preferably, a peel-back strip 24 is placed over the adhesive backing 22, and can be removed for attaching the tape element 10 to a surface.

As shown in FIG. 1, at one end of the tape a pair of wire leads 12*a* and 14*a* are stripped off and connected to a three volt power source 26, lead 12*a* being connected to positive and lead 14*a* being connected to ground. In this manner, a voltage of 3 volts is impressed across the elongated wires 12, 14, and therefore a 3 volt potential is established across each of the LEDs 16. The tape 10 can be cut off at any position along its length, and a 3 volt potential will remain across the LED's. Preferably, the power source is provided through batteries maintained in a battery pack 28.

Referring now to FIG. 3, an illuminated tape includes a tape element, which is similar to the element 10 shown in FIGS. 1–2, with corresponding elements being designated by corresponding numbers increased by 100. Unlike the FIGS. 1–2 embodiment, a plurality of LED chips 116 are connected across each of the wires 112, 114. This sets up an increased voltage drop across the wires 112, 114, which in the example of FIG. 3 will produce a resultant voltage drop of 3 volts for each LED element 116. Accordingly, the tape 110 of FIG. 3 may be connected across a 12 volt dc power source, such as is available in automobile applications.

As noted above, the tape elements 10, 110 are extremely thin and thereby flexible. The tapes, which are flat, may be rolled up in manufacture for shipment and storage, and merely unrolled to the desired length for use. The electrical elements are completely embedded in plastic, and therefore the unit is waterproof and safe.

The method of manufacturing the tape according to the invention will now be described with reference to FIGS. 1 and 2. A pair of elongated thin wires 12, 14 are laid out in parallel and secured temporarily in position. Thereafter, a plurality of LED chips 116 are positioned between the wires 12, 14 at longitudinally spaced intervals, and connected by connecting wires 18, 20 (e.g. by soldering) so as to be electrically connected across the leads 12, 14. Thereafter, the ladder configuration is placed in a mold, e.g. an open channel mold, and epoxy is poured in. Plastic materials which are resilient and translucent, and which can be poured in liquid form into a mold as heretofore described, are well known, and such process need not be described further.

It should be apparent from the foregoing description of the manufacturing process that precise location of the LEDs 16 and wires 12, 14, 18 and 20 in the mold is not critical, in that the epoxy will flow around all of the elements in situ.

The foregoing represents a description of preferred embodiments. Variations and modifications of the embodiments described and shown herein will be apparent to persons skilled in the art, without departing from the inventive concepts disclosed herein. All such variations and modifications are intended to be within the scope of the invention, as defined in the following claims.

I claim:

1. A weatherproof, illuminated tape comprising:

a pair of longitudinally extending thin wires, said wires being laterally spaced apart;

a plurality of LED elements positioned between the wires and spaced longitudinally therealong;

a plurality of thin electrical connectors electrically connecting the LED elements across the wires; wherein the wires, LED elements, and connectors lie essentially in a plane; and an elongated, flat, thin tape element having a thickness slightly greater than said LED elements, wherein said tape element is composed of at least partially translucent plastic, and is formed by disposing said plastic, in liquid form, around said wires, LED elements, and connectors so as to completely embed the same.

2. An illuminated tape as claimed in claim 1, wherein the plastic is flexible, wherein each LED element is an LED chip, and wherein the tape element has a thickness slightly greater than the chip.

3. An illuminated tape as claimed in claim 2, wherein the tape element has top and bottom surfaces, and an adhesive backing on one of the surfaces.

4. An illuminated tape as claimed in claim 2, wherein the plastic is transparent.

5. An illuminated tape as claimed in claim 2, wherein for each parallel connection, more than one LED chip is connected in series across the wires.

6. A method for manufacturing a weatherproof, illuminated tape comprising the steps of:

arranging a pair of elongated, thin wires so as to extend generally parallel to one another;

positioning a plurality of LED elements between the wires so as to be longitudinally spaced therealong;

connecting the LED elements electrically across the pair of elongated wires; and completely embedding the wires, LED elements, and connectors in a liquid, at least partially translucent, plastic and molding and cooling said plastic to form an elongated, flat, thin tape element having a thickness slightly greater than said LED elements.

7. A method according to claim 6, comprising the step of providing a plurality of LED chips, wherein the LED elements are said LED chips, and wherein the plastic is molded to a thickness slightly greater than said LED chips.

8. A method according to claim 7, wherein said tape element has a bottom surface, and comprising the step of affixing an adhesive backing to said bottom surface.

* * * * *